US005333682A

United States Patent [19]

Liu et al.

[11] Patent Number: 5,333,682

[45] Date of Patent: Aug. 2, 1994

[54] HEAT EXCHANGER TUBE

[75] Inventors: Xin Liu, Syracuse; Steven J. Spencer, Liverpool; Neelkanth S. Gupte, Syracuse; Robert H. L. Chiang, Liverpool; Daniel Gaffaney, Chittenango, all of N.Y.

[73] Assignee: Carrier Corporation, Syracuse, N.Y.

[21] Appl. No.: 120,197

[22] Filed: Sep. 13, 1993

[51] Int. Cl.[5] ..... F28F 1/26

[52] U.S. Cl. ..... 165/133; 165/184; 165/911

[58] Field of Search ..... 165/133, 179, 184, 911

[56] References Cited

U.S. PATENT DOCUMENTS

| | | | |
|---|---|---|---|
| Re. 30,077 | 8/1979 | Kun et al. | 165/133 |
| 3,496,752 | 2/1970 | Kun et al. | 72/324 |
| 3,696,861 | 10/1972 | Webb | 165/133 |
| 3,768,290 | 10/1973 | Zatell | 72/68 |
| 4,059,147 | 11/1977 | Thorne | 165/133 |
| 4,765,058 | 8/1988 | Zohler | 29/727 |
| 5,054,548 | 9/1992 | Zohler | 165/133 |
| 5,146,979 | 9/1992 | Zohler | 165/133 |
| 5,203,404 | 4/1993 | Chiang et al. | 165/133 |

*Primary Examiner*—John C. Fox

[57] ABSTRACT

A tube for use in a heat exchanger where heat is transferred between a fluid flowing through the tube and a fluid flowing around the exterior of the tube and where the fluid external to the tube boils during the heat exchange process. The tube has one or more external fin convolutions extending from its external surface. At intervals along each side surface of the fin convolutions there are shoulder notches extending from the fin side surfaces. The groove space between adjacent fin convolutions has raised teeth located circumferentially at intervals. The fin convolutions do not extend perpendicularly from the tube surface but are inclined, with one convolution overlying an adjacent groove but not touching its adjacent neighbor fin convolution to form a re-entrant boiling cavity with an opening gap. In one embodiment, the opening gap extends completely around the circumference of the tube. In another embodiment, the curved fin convolutions are depressed at intervals around the circumference of the tube so that a fin convolution is in close proximity to its adjacent neighbor closing the gap in the vicinity of the depression.

10 Claims, 3 Drawing Sheets

HEAT EXCHANGER TUBE

BACKGROUND OF THE INVENTION

The present invention relates generally to heat exchanger tubes. In particular, the invention relates to the external surface configuration of a heat exchanger tube that is used for evaporation of a liquid in which the tube is submerged.

Many types of air conditioning and refrigeration systems contain shell and tube type evaporators. A shell and tube evaporator is a heat exchanger in which a plurality of tubes are contained within a single shell. The tubes are customarily arranged to provide a multiplicity of parallel flow paths through the heat exchanger for a fluid to be cooled. The tubes are immersed in a refrigerant that flows through the heat exchanger shell. The fluid is cooled by heat transfer through the walls of the tubes. The transferred heat vaporizes the refrigerant in contact with the exterior surface of the tubes. The heat transfer capability of such an evaporator is largely determined by the heat transfer characteristics of the individual tubes. The external configuration of an individual tube is important in establishing its overall heat transfer characteristics.

There are several generally known methods of improving the heat transfer performance of a heat exchanger tube. Among these are (1) increasing the heat transfer area of the tube surface and (2) promoting nucleate boiling on the surface of the tube that is in contact with the boiling fluid. In the nucleate boiling process, heat transferred from the heated surface vaporizes liquid in contact with the surface and the vapor forms into bubbles. Heat from the surface evaporates the liquid surrounding the vapor bubble and the bubble grows in size. When the bubble size is sufficient, surface tension is overcome and the bubble breaks free of the surface. As the bubble leaves the surface, liquid enters the volume vacated by the bubble and vapor remaining in the volume has a source of additional liquid to vaporize to form another bubble. The continual forming of bubbles at the surface, the release of the bubbles from the surface and the rewetting of the surface together with the convective effect of the vapor bubbles rising through and mixing the liquid result in an improved heat transfer rate for the heat transfer surface.

It is also well known that the nucleate boiling process can be enhanced by configuring the heat transfer surface so that it has nucleation sites that provide locations for the entrapment of vapor and promote the formation of vapor bubbles. Simply toughening a heat transfer surface, for example, will provide nucleation sites that can improve the heat transfer characteristics of the surface over an otherwise similar smooth surface.

In boiling liquid refrigerants, for example in the evaporator of an air conditioning or refrigeration system, nucleation sites of the re-entrant type produce bubble columns and good surface heat transfer characteristics. A re-entrant type nucleation site is a surface cavity in which the opening of the cavity is smaller than the width of subsurface cavity. An excessive influx of the surrounding liquid can flood a re-entrant type nucleation site and deactivate it. By configuring the heat transfer surface so that it has relatively larger communicating subsurface channels with relatively smaller openings to the surface, flooding of the vapor entrapment or nucleation sites can be reduced or prevented and the heat transfer performance of the surface improved.

SUMMARY OF THE INVENTION

The present invention is a heat transfer tube having an external surface configured to provide improved heat transfer performance by both increasing the area of the tube external surface and by providing re-entrant cavities as nucleation sites to promote nucleate boiling.

The tube has one or more fin convolutions extending from its external surface. At intervals along each side shoulder surface of the fin convolutions, there are notches impressed into the shoulder surfaces with notch protrusions extending from the fin shoulders. The groove space between adjacent fin convolutions contains raised teeth at intervals. The fin convolutions do not extend perpendicularly from the tube surface but are curved one convolution over its adjacent neighbor. In one embodiment, a fin convolution does not touch its adjacent neighbor but a gap is left to allow bubbles of vaporized liquid to escape from the tube surface. In another embodiment, closure depressions at intervals around the circumference of the tube result in adjacent fin convolutions touching in the area of the closure depressions.

The configuration of the tube external surface thus increases the area of the surface exposed to the fluid in contact with the surface. As well, the configuration provides re-entrant cavities that promote nucleate boiling. Both these features of the tube serve to enhance the heat transfer performance of the tube.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
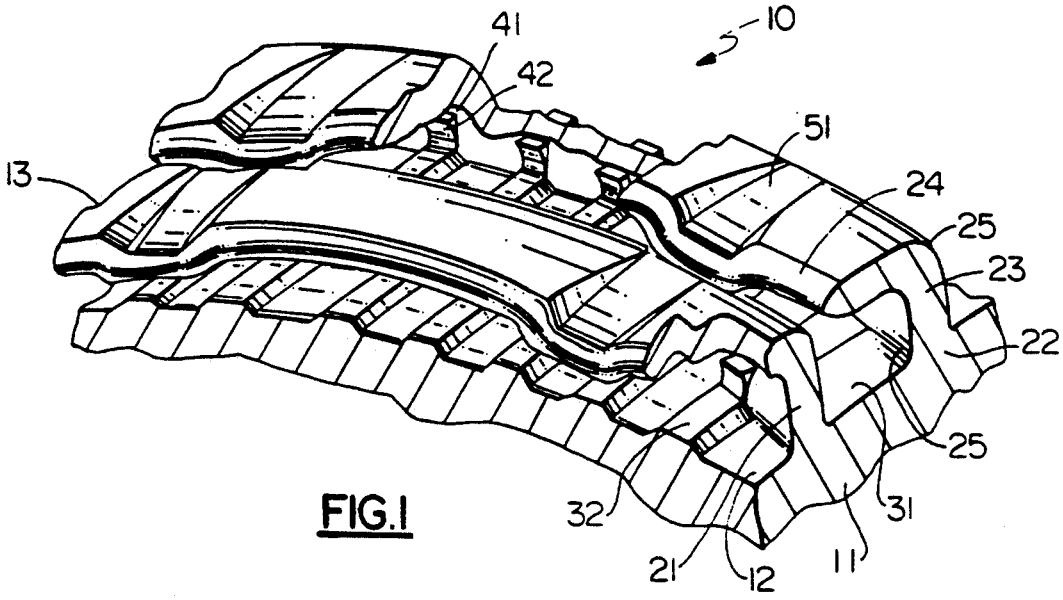
FIG. 1 is a perspective view of a portion of the external surface of the heat exchanger tube of the present invention.

FIG. 1 depicts a perspective view of a portion of the external surface of a heat exchanger tube 10 manufactured according to the teaching of the present invention. Extending helically along the longitudinal axis of tube 10 and radially outward from external surface 12 of wall 11 of tube 10 are fin convolutions 21. Between each adjacent fin convolution is a groove 31. There may be one or a plurality of fin convolutions on the tube. The normal method of manufacture of a heat exchanger tube of this type is by rolling the tube wall between an internal mandrel and an external firming tool or tools. If this method is used, the number and set up of the external finning tools determine the number of fin convolutions.

Fin convolution 21 comprises root 22 joined to external surface 12, body 23 and tip 24. The external surfaces of body 23 are shoulders 25. Each fin convolution inclines over to overlay an adjacent groove 31 thus forming a subsurface channel. There are notches 41 at intervals along shoulders 25. When these notches are formed by a notching tool during the manufacturing process, the notching tool may displace material from body 23. This displaced material will form protrusions 42 extending out from shoulders 25 at that portion of notches 41 that are closest to root 21. In groove 31 and extending from external surface 12 are a plurality of teeth 32. In one embodiment of the present invention, there are closure depressions 51 at intervals around the circumference of the tube.

Figure 2:
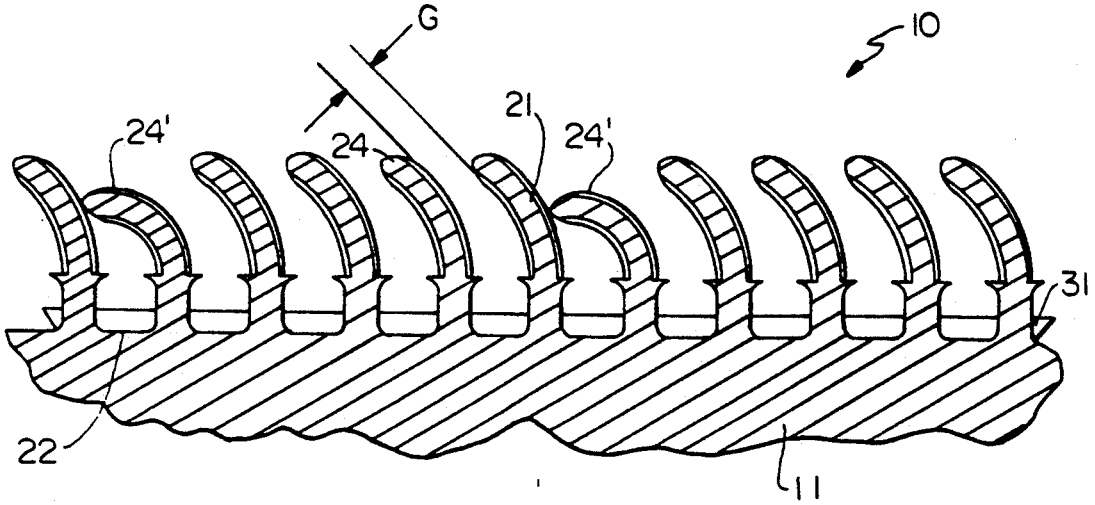
FIG. 2 is a sectioned elevation view of a portion of the external surface of the heat exchanger tube of the present invention.

FIG. 2 is a sectioned elevation view of a portion of the external surface of the heat exchanger tube of the present invention. In this view can be seen a number of fin convolutions 21 extending from external surface 22 of tube 10. Over most of the external surface, tip 24 of one fin convolution is inclined so that it does not contact its adjacent neighbor. There is thus an opening gap having gap width G between tip 24 and the adjacent fin convolution. In areas of closure depressions 51 (FIG. 1), tip 24' nearly contacts or does contact its neighbor leaving a very small or no opening gap.

Figure 4:
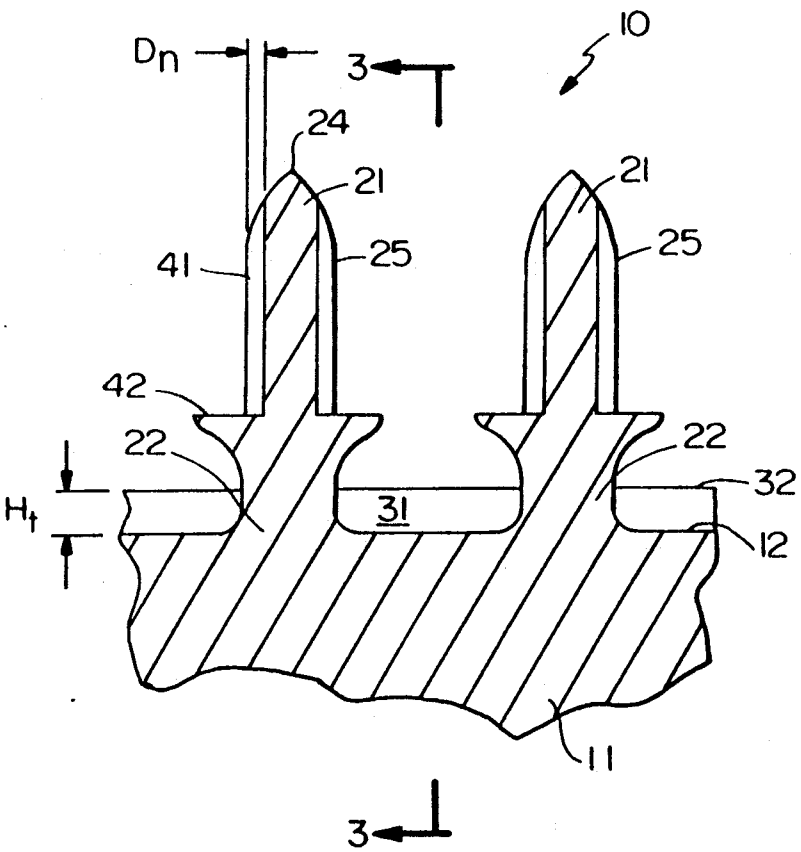
FIG. 4 is a sectioned, through line 4—4 in FIG. 3, partial elevation view of the external surface of the heat exchanger tube of the present invention as it is at an intermediate stage of manufacture.
Figure 3:
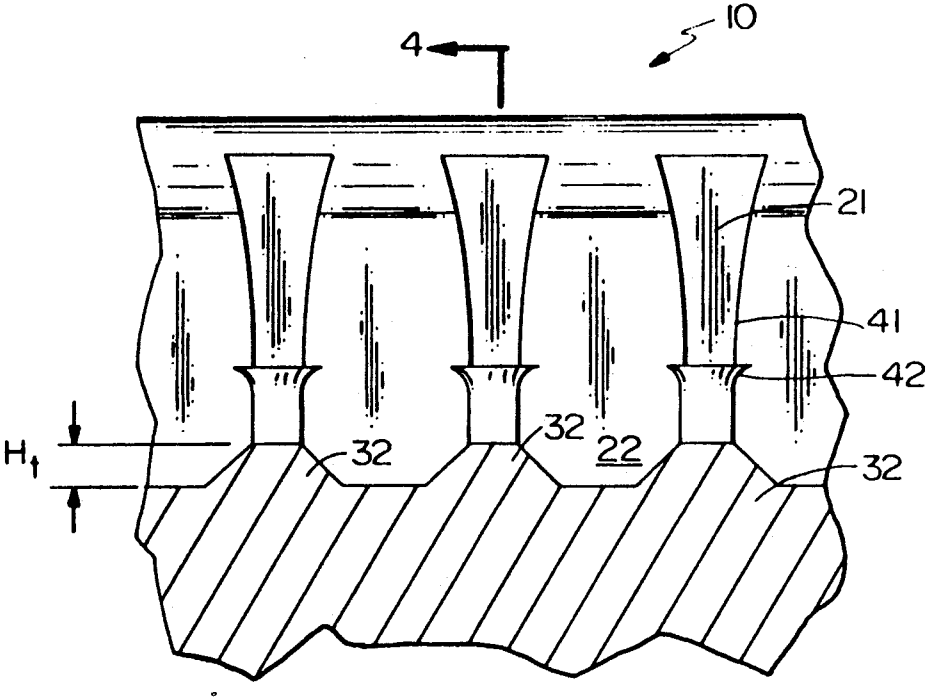
FIG. 3 is a sectioned, through line 3—3 in FIG. 4, partial elevation view of the external surface of the heat exchanger tube of the present invention as it is at an intermediate stage of manufacture.

FIGS. 3 and 4 show details of the configuration of the fin convolution. Note that these figures show tube 10 in an intermediate stage of manufacture before fin convolutions 21 are bent over. In groove 31 between adjacent fin convolutions 21 are located teeth 32 extending to height $H_t$ above surface 12. There are shoulder notches 41 at intervals on both shoulders 25 of fin convolution 21. A notch extends into a fin convolution to depth $D_n$. Material displaced in making the shoulder notch during manufacturing protrudes from shoulder 25 at the end of notch 41 that is closest to fin root 22. The presence of the notch and the notch protrusion increase the external surface area of tube 10 as well as assist in promoting nucleate boiling. FIG. 3 shows shoulder notches 41 and teeth 32 to be in alignment but this may or may not be the case, particularly if these features are placed on the tube at different stages of the manufacturing process.

Figure 5:
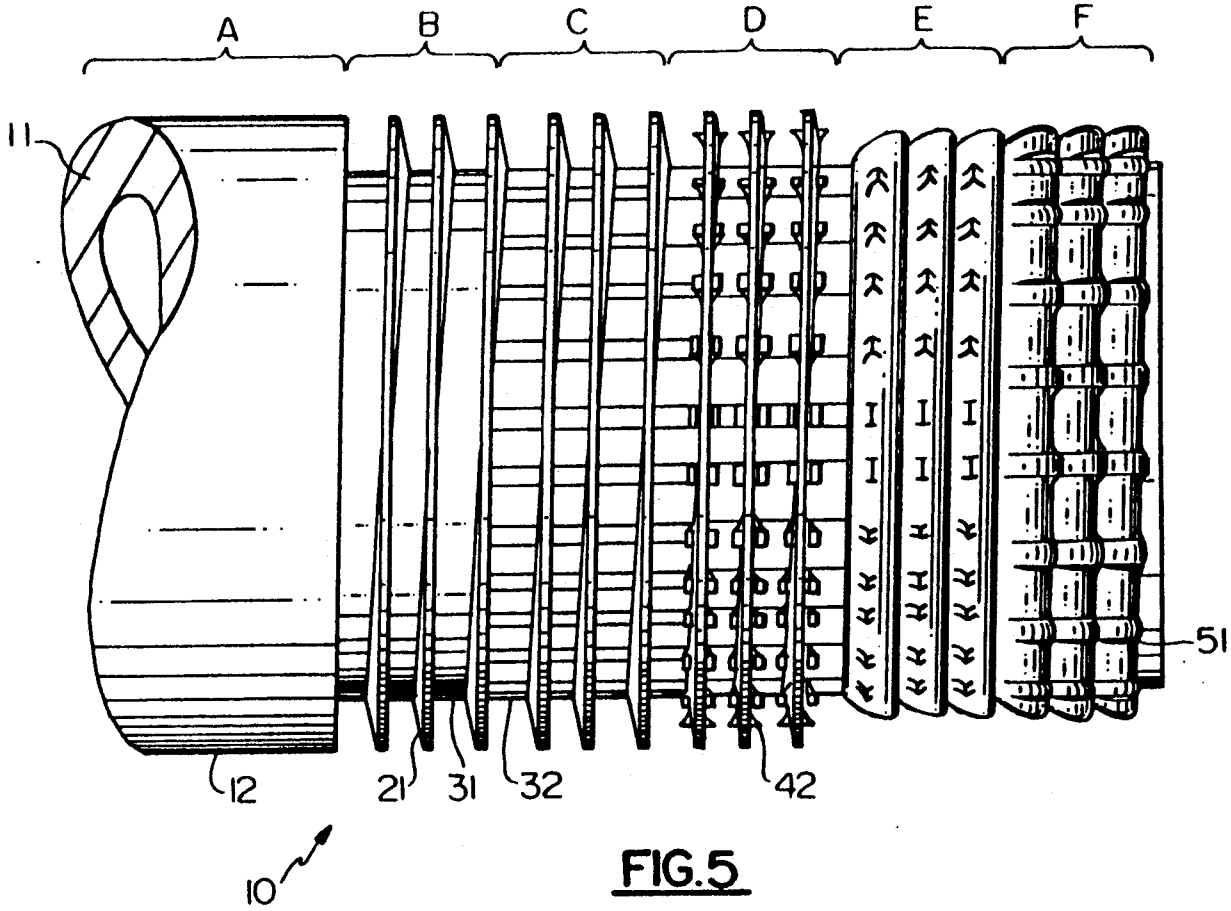
FIG. 5 is a schematic view of the heat exchanger tube of the present invention showing the progressive steps by which the tube is manufactured.

FIG. 5 shows schematically how the heat exchanger tube of the present invention appears at various stages of its manufacture by a rolling process and assists in understanding the configuration of the tube. The figure shows a section of tube 10 divided into six regions, each designated by a letter. Region shows the tube before any working. The first step in manufacturing the tube is to roll fin convolutions 21 into wall 11, leaving a groove 31 between each adjacent fin convolution. The tube then appears as in region B. In a second step, teeth 32 are formed in groove 31 (region C). Thirdly, shoulder notches 41 and protrusions 42 are formed in fin convolutions 21 (region D). Then fin convolution 21 is rolled over so that it overlays groove 31 but does not contact the adjacent convolution (region E). Finally in one embodiment of the present invention, as shown in region E, closure depressions 51 may be rolled at intervals around the circumference of tube 10 causing the gap between adjacent fins to close in the vicinity of each depression 51.

We have determined that optimum heat transfer performance and manufacturability can be achieved when the tube of the present invention is made to certain geometric and dimensional relationships. The optimum fin pitch is 0.36 to 0.64 mm (0.014 to 0.025 inch). e, the width of the gap between a fin convolution and its neighbor, should be between 0.025 and 0.203 mm (0.001–0.008 inch). Mr, the height of the teeth in the groove, should be between 0.051 and 0.178 mm (0.002 and 0.007 inch). There should be between 25 and 250 teeth per convolution turn. $D_n$, the maximum depth of the notches in the fin convolution shoulders, should be about 0.051 mm (0.002 inch). And there should be about 25 to 250 notches per convolution turn. In the embodiment of the present invention having closure depressions, there should be between 40 and 80 depressions per convolution turn.

We claim:

1. An improved heat exchanger tube (10) for transferring heat between a fluid flowing through the interior of said tube and a boiling fluid that is in contact with the exterior surface (12) of said tube of the type having at least one fin convolution (21) formed on said exterior surface, said fin convolution extending helically along the longitudinal axis of said tube and radially from said exterior surface and having a root (22) joined to said exterior surface, a body (23) extending from said root and having two opposite shoulders (25) and a distal tip (24) extending from said body, and a groove (31) portion of said exterior surface formed between adjacent turns of said fin convolution in which the improvement comprises:

notches (41) in said shoulders, raised teeth (32) extending from said external surface in said groove portion and said distal tip being inclined so that said tip overlies an adjacent groove to form a subsurface channel having an opening between said distal tip and an adjacent turn of said fin convolution.

2. The heat exchanger tube of claim 1 in which the fin pitch is 0.36 to 8.64 mm (0.014 to 0.025 inch).

3. The heat exchanger tube of claim 1 in which said opening gap (G) is between 0.025 and 0.203 mm (0.001 and 0.008 inch).

4. The heat exchanger tube of claim 1 in which said raised teeth extend 0.051 and 0.178 mm (0.002 and 0.007 inch) above said exterior surface.

5. The heat exchanger tube of claim 1 in which there are 25 to 250 said teeth in said groove per convolution turn.

6. The heat exchanger tube of claim 1 further comprising protrusions (42) extending from said shoulders at each notch.

7. The heat exchanger of claim 1 in which said notches (41) have a maximum depth of 0.051 mm (0.002 inch).

8. The heat exchanger of claim 1 in which there are 25 to 250 said notches per convolution turn.

9. The heat exchanger of claim 1 further comprising closure depressions (51) along said fin convolution where said distal tip in one convolution turn inclines sufficiently to be in close proximity to a shoulder in an adjacent convolution turn.

10. The heat exchanger of claim 9 in which there are 40 to 80 said closure depressions per convolution turn.

* * * * *